US008593082B2

(12) United States Patent
Liang et al.

(10) Patent No.: US 8,593,082 B2
(45) Date of Patent: Nov. 26, 2013

(54) SYSTEM AND METHOD FOR ADJUSTING COLOR TEMPERATURE

(75) Inventors: Kun Liang, Shenzhen (CN); Tsang-Chiang Yang, New Taipei (TW); Gwo-Yan Huang, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 212 days.

(21) Appl. No.: 13/330,552

(22) Filed: Dec. 19, 2011

(65) Prior Publication Data

US 2013/0134900 A1 May 30, 2013

(30) Foreign Application Priority Data

Nov. 30, 2011 (CN) ..... 2011 1 0389680

(51) Int. Cl.
*G05F 1/10* (2006.01)

(52) U.S. Cl.
USPC ..... 315/307

(58) Field of Classification Search
USPC ..... 315/291, 294, 246, 307, 209 R
See application file for complete search history.

(56) References Cited

U.S. PATENT DOCUMENTS 6,883,929 B2 * 4/2005 Dowling ..... 362/192
6,963,175 B2 * 11/2005 Archenhold et al. ..... 315/291

* cited by examiner

*Primary Examiner* — Minh D A
(74) *Attorney, Agent, or Firm* — Altis & Wispro Law Group, Inc.

(57) ABSTRACT

A color temperature adjusting system includes a processing unit, a constant-current drive unit, and an light emitting unit (LED) unit including two unmatched LED modules with different basic color temperatures. A table records a relationship between coefficient values and current values for the current(s) flowing through the two LED modules. The processing unit selects one of a number of predetermined formulas to calculate the coefficient value by comparing a desired value with a threshold value, and further determines the current values according to the calculated coefficient value listed in a table. The constant-current drive unit includes two drive module generating modulating signals to adjust the respective values of the current flowing through the two LED modules to match the determined current values, thereby adjusting the color temperature value of the LED unit to the desired level. A related method is also provided.

11 Claims, 2 Drawing Sheets

SYSTEM AND METHOD FOR ADJUSTING COLOR TEMPERATURE

BACKGROUND

1. Technical Field

The present disclosure relates to a system and method for adjusting color temperature.

2. Description of the Related Art

Many LED lamps includes a number of LED modules each with a different color temperature, and the luminance of the LED modules can be adjusted by pulse width modulation (PWM) signals provided by constant-current drive circuit of each LED module, thus the color temperature of the LED lamps can be adjusted to a desired value. Integrated circuits (ICs) may be employed in the LED lamp to adjust the color temperature values of the LED lamp over a wide range. However, these ICs have complicated structures and are expensive.

Therefore, there is room for improvement within the art.

BRIEF DESCRIPTION OF THE DRAWINGS

The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
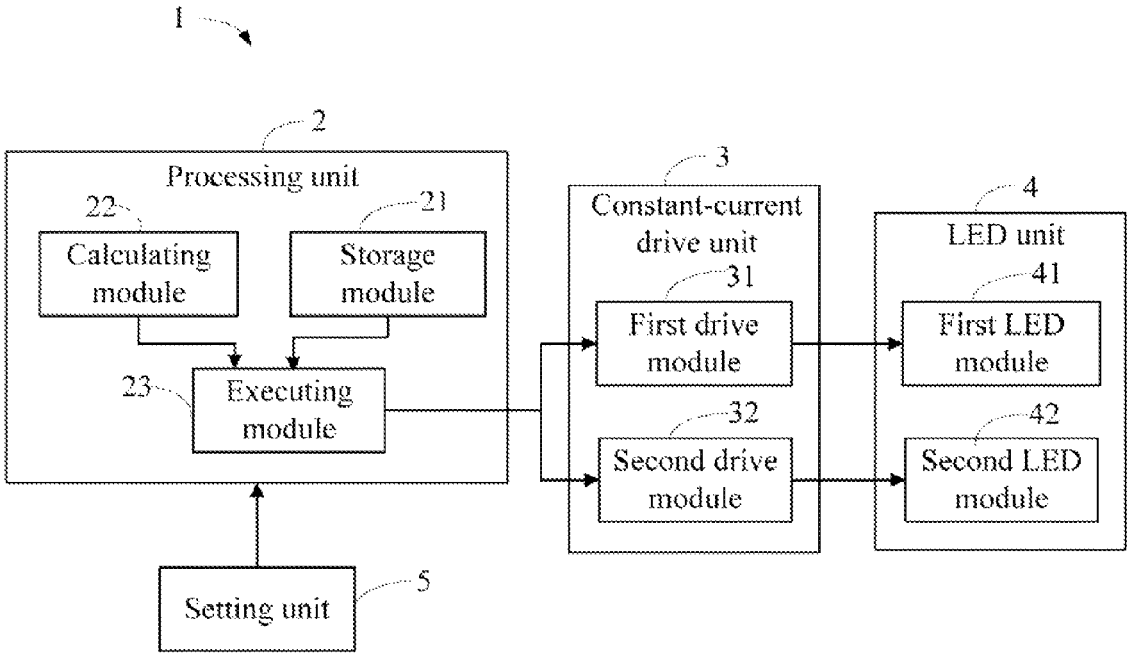
FIG. 1 is a block diagram of a system for adjusting color temperatures of an LED unit in accordance with an exemplary embodiment.

Referring to FIG. 1, a system for adjusting color temperatures is provided. The system 1 includes a processing unit 2, a constant-current drive unit 3, a light emitting diode (LED) unit 4 and a setting unit 5. The LED unit 4 includes a first LED module 41 and a second LED module 42 which has color temperature different from that of the first LED module 41. In the embodiment, the first LED module 41 is a white LED module with a relatively low value of color temperature, such as 2700K (Kelvin). The second LED module 42 is a white LED module with a relatively high value of color temperature, such as 6500K. When only the first LED module 41 is working, the color temperature value of the LED unit 4 is the lowest, for example, at 2700K. When only the second LED module 42 is working, the color temperature value of the LED unit 4 is the highest, for example, at 6500K.

When a user inputs a desired value for a correlated color temperature (CCT) via the setting unit 5, the setting unit 5 generates signals for adjusting the color temperature of the LED unit 4 to the desired value CCT in response to the user's input. In the embodiment, the setting unit 5 may be a touch panel with a display screen, a keyboard, a remote control or the like.

The processing unit 2 includes a storage module 21, a calculating module 22, and an executing module 23. The storage module 21 is configured to store a table, as shown below, the table includes a coefficient X column which records a coefficient for each desired value, a $I_1$ column, and a $I_2$ column which respectively record first current values $I_1$ of the current flowing through the first LED module 41, and second current values $I_2$ of the current flowing through the second LED module 42, to achieve the desired values.

The table stored in the storage module 21

| X | I1 (mA) | I2 (mA) |
|---|---|---|
| 1.0000 | 60.00 | 0.00 |
| 0.9522 | 60.00 | 2.7 |
| 0.9043 | 60.00 | 5.71 |
| 0.8565 | 60.00 | 9.04 |
| 0.8086 | 60.00 | 12.76 |
| 0.7608 | 60.00 | 16.96 |
| 0.7129 | 60.00 | 21.72 |
| 0.6651 | 60.00 | 27.16 |
| 0.6172 | 60.00 | 33.44 |
| 0.5694 | 56.31 | 38.28 |
| 0.5215 | 51.84 | 42.74 |
| 0.4737 | 47.32 | 47.26 |
| 0.4258 | 42.76 | 51.82 |
| 0.3780 | 38.15 | 56.43 |
| 0.4075 | 41.00 | 53.58 |
| 0.3905 | 39.36 | 55.22 |
| 0.3735 | 37.72 | 56.86 |
| 0.3565 | 36.07 | 58.51 |
| 0.3396 | 34.32 | 60.00 |
| 0.3226 | 31.79 | 60.00 |
| 0.3056 | 29.38 | 60.00 |
| 0.2886 | 27.09 | 60.00 |
| 0.2716 | 24.90 | 60.00 |
| 0.2547 | 22.81 | 60.00 |
| 0.2377 | 20.82 | 60.00 |
| 0.2207 | 18.91 | 60.00 |
| 0.2037 | 17.08 | 60.00 |
| 0.1868 | 15.33 | 60.00 |
| 0.1698 | 13.65 | 60.00 |
| 0.1528 | 12.04 | 60.00 |
| 0.1358 | 10.49 | 60.00 |
| 0.1188 | 9.00 | 60.00 |
| 0.1019 | 7.57 | 60.00 |
| 0.0849 | 6.19 | 60.00 |
| 0.0679 | 4.86 | 60.00 |
| 0.0509 | 3.58 | 60.00 |
| 0.0340 | 2.35 | 60.00 |
| 0.0170 | 1.15 | 60.00 |
| 0.0000 | 0.00 | 60.00 |

The first current values $I_1$ are inversely proportional to the desired value of CCT, and the second current values $I_2$ are directly proportional to the desired value CCT. For example, if 3600K is input, via the setting unit 5, as the desired value CCT, the corresponding first current value $I_1$ and the corresponding second current value $I_2$ are found to be 56.31 mA and 38.28 mA respectively from the table, as show above. If the desired value CCT input via the setting unit 5 is 3800K, the corresponding first current value $I_1$ and the corresponding second current value $I_2$ of the coefficient X are obtained from the table and found to be 47.32 mA and 47.26 mA respectively, as shown above.

The calculating module 22 is configured to apply one or more formulas for calculating the coefficient X by comparing the desired value CCT with a threshold value CCT(0) in response to the signals generated by the setting unit 5.

In the embodiment, there are three predetermined formulas used to calculate the coefficient X, the three predetermined formulas are:

$$CCT(0)=CCT(1)+\Delta CCT*A_0; \quad \text{First formula:}$$

$$\text{when } CCT<=CCT(0), CCT=CCT(1)+\Delta CCT*(1-X)*A_1; \text{ and} \quad \text{Second formula:}$$

$$\text{when } CCT>CCT(0), CCT=CCT(2)-\Delta CCT*X*A_2. \quad \text{Third formula:}$$

In the three formulas, $A_0$, $A_1$, $A_2$ are constant values preset according to an illumination device employing the system 1.

CCT(1) is the color temperature value of the first LED module 41. CCT(2) is the color temperature value of the second LED module 42. ΔCCT is a fixed value difference between the color temperature value of the second LED module 42 CCT(2) and the color temperature value of the first LED module 41 CCT(1). In the embodiment, ΔCCT is 3800K (solving 6500-2700). CCT(0) is the fixed threshold value calculated according to the first formula. The executing module 23 determines the choice of formula from between the second formula and the third formula to calculate the coefficient X by comparing the desired value CCT with the threshold value CCT(0). If the desired value CCT is equal to or less than the threshold value CCT(0), the second formula is used to calculate the coefficient X. If the desired value CCT is greater than the threshold value CCT(0), the first formula is used to calculate the coefficient X.

The executing module 23 is configured to determine the first current value $I_1$ and the second current value $I_2$ according to the coefficient value X produced by the calculating module 22.

The constant-current drive unit 3 includes a first drive module 31 connected to the first LED module 41, and a second drive module 32 connected to the second LED module 42. The first drive module 31 and the second drive module 32 are both connected to the executing module 23. The first drive module 31 is configured to generate a first modulated signal to adjust the current flowing through the first LED module 41 to equal the first current value $I_1$ as determined by the executing module 23. The second drive module 32 is configured to generate a second modulated signal to adjust the current flowing through the second LED module 42 to equal the second current value $I_2$ as determined by the executing module 23. Thereby, the color temperature value of the overall LED unit 4 may be adjusted to be the desired value for CCT.

For example, if the desired value CCT set by the setting unit 5 is 2800K which is less than the threshold value CCT(0), the second formula is selected to calculate the coefficient X and the calculating module 22 functions accordingly to establish 0.9522 as the coefficient X. Thus, the corresponding first current value $I_1$ (60 mA) and the corresponding second current value $I_2$ (2.7 mA) of the coefficient X can be obtained from the table as shown above. The first drive module 31 generates the first modulated signal to adjust the current flowing through the first LED module 41 to be 60.00 mA, and the second drive module 32 generates the second modulated signal to adjust the current flowing through the second LED module 42 to be 2.7 mA. In this way, the color temperature color value of the LED unit 4 is adjusted to the desired value (2800K).

Figure 2:
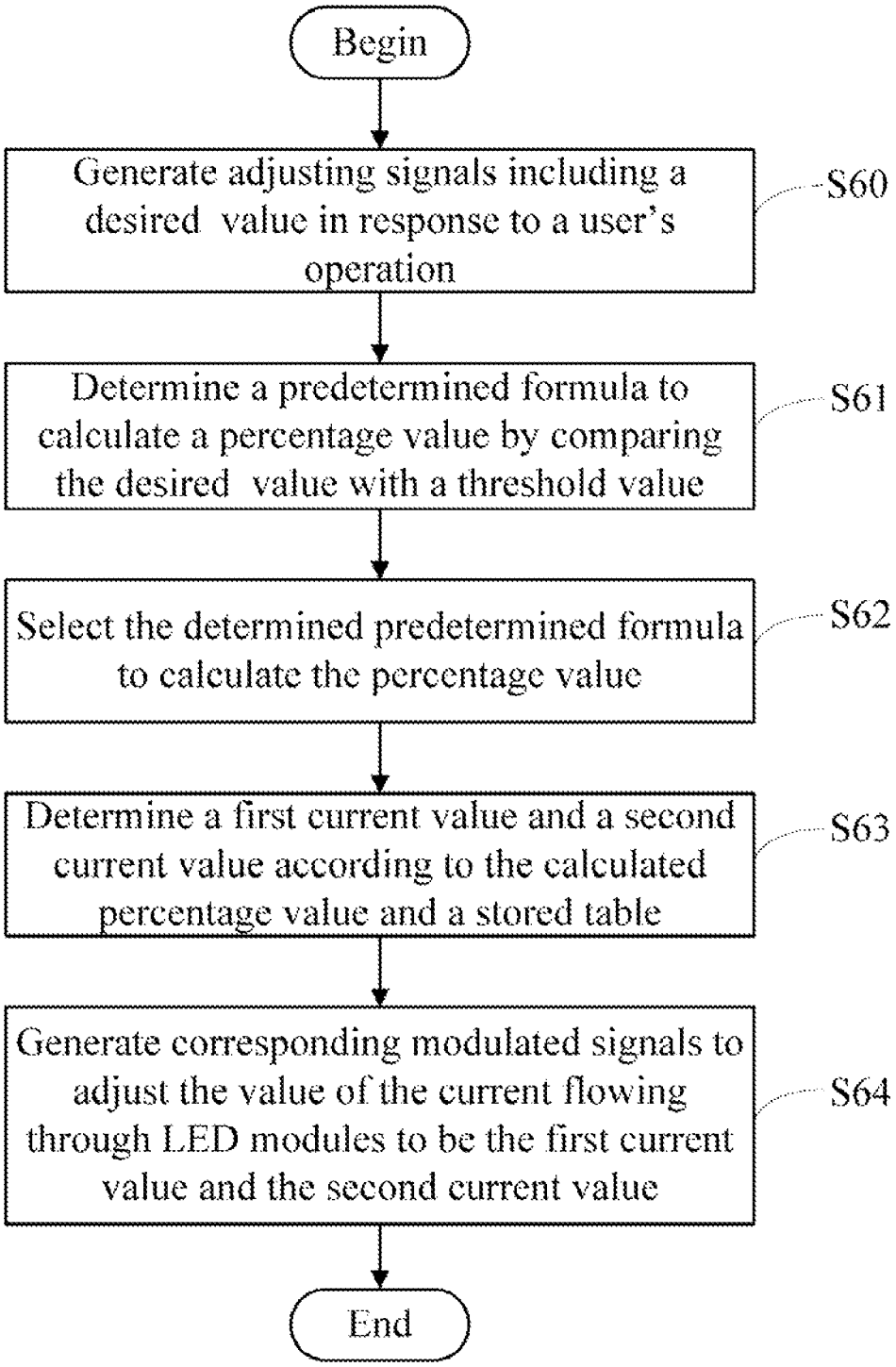
FIG. 2 is a flow diagram that describes steps in a method for adjusting color temperature of the LED unit in accordance with an exemplary embodiment.

FIG. 2 is a flow diagram that describes the steps in a method in accordance with an exemplary embodiment.

In step S60, the setting unit 5 generates adjusting signals to achieve the desired value for CCT in response to user's operation.

The setting unit 5 may be a touch panel with a display screen, a keyboard, or a remote control.

In step S61, the calculating module 22 determines the formula to be applied in calculating the coefficient X by comparing the desired value CCT with the threshold value CCT(0) when receiving the adjusting signals generated by the setting unit 5.

In the embodiment, there are three predetermined formulas available for calculating the coefficient value X, the three predetermined formulas are:

$$CCT(0)=CCT(1)+\Delta CCT*A_0; \quad \text{First formula:}$$

$$\text{when } CCT<=CCT(0), CCT=CCT(1)+\Delta CCT*(1-X)*A_1; \text{ and} \quad \text{Second formula:}$$

$$\text{when } CCT>CCT(0), CCT=CCT(2)-\Delta CCT*X*A_2. \quad \text{Third formula:}$$

In the three formulas, $A_0$, $A_1$, $A_2$ are constant values. CCT(1) is the lowest color temperature value of the LED unit 4, namely, the color temperature value of the first LED module 41. CCT(2) is the highest color temperature value of the LED unit 4, namely, the color temperature value of the second LED module 42. ΔCCT is a fixed value difference between the highest color temperature value CCT(2) and the lowest color temperature value CCT(1) of the LED unit 4. In the embodiment, ΔCCT is 3800K (solving 6500-2700). CCT(0) is a fixed threshold value calculated according to the first formula. If the desired value CCT is equal to or less than the threshold value CCT(0), the second formula is used to calculate the coefficient X. If the desired value CCT is greater than the threshold value CCT(0), the third formula is used to calculate the coefficient X.

In step S62, the calculating module 22 selects the formula to be applied in calculating the coefficient value X. The coefficient value X is a ratio of the color temperature value of the first LED module 41 over the desired value CCT.

In step S63, the executing module 23 establishes the first current value $I_1$ and the second current value $I_2$ according to the coefficient value X as calculated by the calculating module 22.

In step S64, the first drive module 31 generates the first modulated signal to adjust the amount of current flowing through the first LED module 41 to equal the established first current value $I_1$, and the second drive module 32 generates the second modulated signal to adjust the amount of current flowing through the second LED module 42 to equal the established second current value $I_2$, thereby adjusting the color temperature value of the LED unit 4 to match the desired color temperature value.

It is understood that the present disclosure may be embodied in other forms without departing from the spirit thereof. The present examples and embodiments are to be considered in all respects as illustrative and not restrictive, and the disclosure is not to be limited to the details given herein.

What is claimed is:

1. A color temperature adjusting system, comprising:

a setting unit configured to generate signals including a desired value CCT for a correlated color temperature in response to a user's operation;

a light emitting diode (LED) unit comprising a first LED module and a second LED module which has color temperature different from that of the first LED module, wherein the color temperature of the first LED module is lower than that of the second LED module;

a processing unit comprising:

a storage module configured to store a table recording a relationship among a number of coefficient values X, first current values $I_1$ of current flowing through the first LED module, and second current values $I_2$ of current flowing through the second LED module;

a calculating module configured to apply one or more formulas for calculate the coefficient value X by comparing the desired value CCT with a threshold value CCT(0), and calculate the coefficient value X according to the applied formula;

an executing module configured to determine the first current value $I_1$ and the second current value $I_2$ according to the coefficient value X produced by the calculating module and the table stored in the storage module;

a constant-current drive unit comprising:

a first drive module connected to the first LED module, configured to generate a first modulated signal to adjust the amount of the current flowing through the first LED module to equal the first current value $I_1$ as determined by the executing module; and a second drive module connected to the second LED module, configured to generate a second modulated signal to adjust the amount of current flowing through the second LED module to equal the second current value $I_2$ as determined by the executing module, thereby adjusting the color temperature value of the overall LED unit to be the desired value CCT.

2. The color temperature adjusting system as recited in claim 1, wherein the calculating module selects a first formula to calculate the coefficient X when the desired value CCT is less than the threshold value CCT(0), and the calculating module selects a second formula to calculate the coefficient X when the desired color temperature value CCT is greater than the threshold value CCT(0).

3. The color temperature adjusting system as recited in claim 2, wherein the first formula is $CCT=CCT(1)+\Delta CCT*(1-X)*A_1$, and the second formula is $CCT=CCT(2)-\Delta CCT*X*A_2$, $A_0$, $A_1$, $A_2$ are constant values, CCT(1) is the color temperature value of the first LED module, CCT(2) is the color temperature value of the second LED module, and ΔCCT is a fixed value difference between the color temperature value CCT(2) of the second LED module and the color temperature value CCT(1) of the first LED module.

4. The color temperature adjusting system as recited in claim 1, wherein the setting unit is a touch panel with a display screen.

5. The color temperature adjusting system as recited in claim 1, wherein the setting unit is a keyboard.

6. The color temperature adjusting system as recited in claim 1, wherein the setting unit is a remote control.

7. The color temperature adjusting system as recited in claim 1, wherein the first current values $I_1$ are inversely proportional to the increasing of the desired color temperature value CCT, and the second current values I2 are directly proportional to the increasing of the desired value CCT.

8. A method for adjusting color temperature applied in a color temperature adjusting system, wherein the color temperature adjusting system comprising a light emitting diode (LED) unit, the LED unit comprising a first LED module and a second LED module with different color temperatures, the color temperature of the first LED module is lower than that of the second LED module; and a storage unit configured to store a table recording a relationship among a number of coefficient values X, first current values $I_1$ of the current flowing through the first LED module, and second current values $I_2$ of the current flowing through the second LED module, and the coefficient value X is a ratio of a color temperature value CCT(1) of the first LED module dividing a desired value CCT; the method comprising:

generating adjusting signals to achieve the desired value for CCT in response to a user's operation;

determining a predetermined formula to be applied in calculating the coefficient X by comparing the desired value CCT with a threshold value CCT(0) in response to the adjusting signals;

calculating the coefficient value X according to the applied formula;

establishing the first current value $I_1$ and the second current value $I_2$ as calculated coefficient value X and the stored table; and generating a first modulated signal to adjust current flowing through the first LED module to equal the established first current value $I_1$, and generating a second modulated signal to adjust current flowing through the second LED module to equal the established second current value $I_2$.

9. The method as recited in claim 8, wherein a first formula is selected to calculate the coefficient X when the desired value CCT is less than the threshold value CCT(0), and a second formula is selected to calculate the coefficient X when the desired CCT is higher than the threshold value CCT(0).

10. The method as recited in claim 9, wherein the first formula is $CCT=CCT(1)+\Delta CCT*(1-X)*A_1$, and the second formula is $CCT=CCT(2)-\Delta CCT*X*A_2$, $A_0$, $A_1$, $A_2$ are constant values, CCT(2) is the color temperature value of the second LED module, ΔCCT is a fixed difference value between the color temperature value CCT(1) of the first LED module and the color temperature value CCT(2) of the second LED module.

11. The method as recited in claim 8, wherein the first current values $I_1$ are inversely proportional to the increasing of the desired value CCT, and the second current values $I_2$ are directly proportional to the increasing of the desired value CCT.

* * * * *